US008544605B2

(12) United States Patent
Kreller

(10) Patent No.: US 8,544,605 B2
(45) Date of Patent: Oct. 1, 2013

(54) SCAFFOLDING COMPRISING AN ANTI-RELEASE DEVICE FOR FLOORING UNITS

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 226 days.

(21) Appl. No.: 12/736,441

(22) PCT Filed: Mar. 10, 2009

(86) PCT No.: PCT/DE2009/000335

§ 371 (c)(1),
(2), (4) Date: Oct. 8, 2010

(87) PCT Pub. No.: WO2009/155890

PCT Pub. Date: Dec. 30, 2009

(65) Prior Publication Data

US 2011/0036665 A1 Feb. 17, 2011

(30) Foreign Application Priority Data

Jun. 27, 2008 (DE) ..... 10 2008 030 602

(51) Int. Cl.
*E04G 5/08* (2006.01)

(52) U.S. Cl.
USPC ..... 182/222; 182/119

(58) Field of Classification Search
USPC ..... 182/222, 119, 179.1; 52/651.1, 52/655.1; 403/112, 113, 117, 146; 16/374, 16/297, 304, 305, 306, 307, 355, 356, 267, 16/268, 269
IPC ..... E04G 1/15, 5/00, 5/06, 5/08, 7/28
See application file for complete search history.

(56) References Cited

U.S. PATENT DOCUMENTS 4,372,424 A 2/1983 Langer
5,894,909 A * 4/1999 Cornish ..... 182/186.8

(Continued)

FOREIGN PATENT DOCUMENTS

DE 30 20 389 12/1981
DE 40 27 754 3/1992

(Continued)

OTHER PUBLICATIONS

New Zealand Examination Report in New Zealand Application No. 588059 dated Jan. 16, 2012.

(Continued)

*Primary Examiner* — Darnell Jayne
*Assistant Examiner* — Kristine Florio
(74) *Attorney, Agent, or Firm* — Collard & Roe, P.C.

(57) ABSTRACT

A scaffolding (20) comprises vertical frame elements (22), crossbeams that extend therebetween, flooring units (27) which have mounting aids (28) to be mounted on the crossbeam (21), and at least one anti-release device (40) for securing the flooring units (27) against being released. The anti-release device (40) can be removably connected to the crossbeam (21) and has a securing member (41) which corresponds to the length of the crossbeam, is to be placed on the mounting aid (28), and is fitted with at least one hook-shaped fastening element (42) that penetrates a hole (33) located in the crossbeam and partially embraces the crossbeam (21) in the anti-release state. One end of the securing member (41) is provided with a pivotable plate which is fastened by means of a hinge and is pivoted from the open position into the locking position and retained by means of a spring mechanism (60). Alternatively or additionally, the hook-shaped fastening element (42) can be made of flat steel, and the parallel lateral surfaces are placed at an adequate distance from the mounting aids (28) in the anti-release state in order to prevent a collision.

11 Claims, 7 Drawing Sheets

(56) References Cited

U.S. PATENT DOCUMENTS

Figure 1:
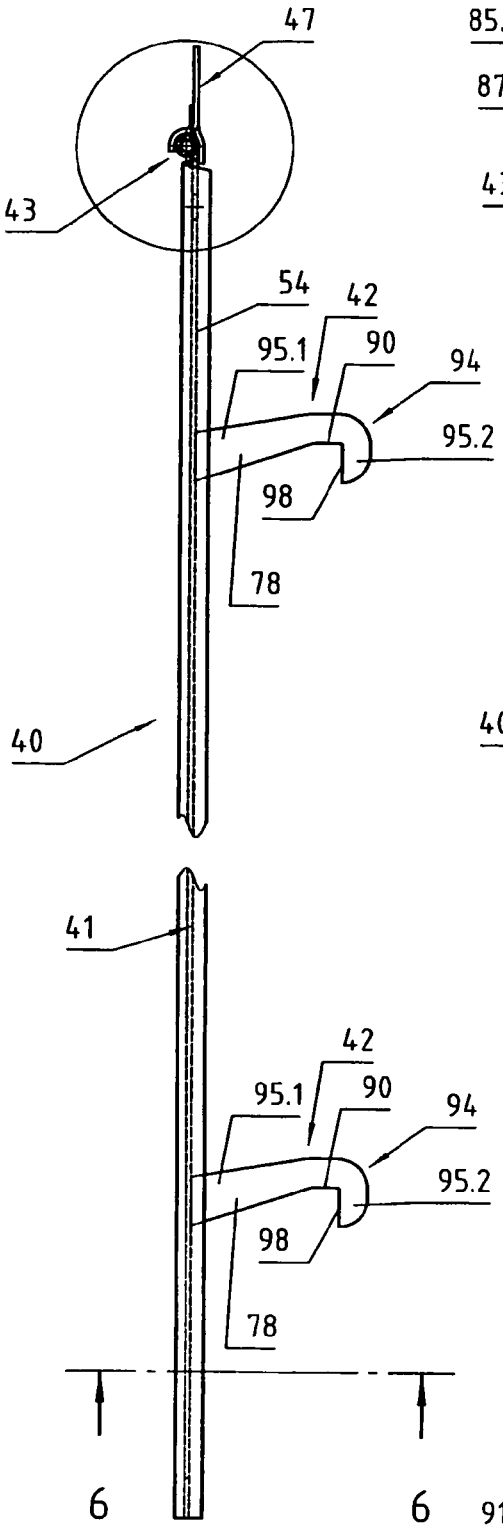

| | | | | |
|---|---|---|---|---|
| 6,305,868 | B1 * | 10/2001 | Kinoshita et al. | 403/49 |
| 6,471,003 | B2 | 10/2002 | Wyse | |
| 2006/0191105 | A1 * | 8/2006 | Walker | 16/355 |
| 2008/0078899 | A1 * | 4/2008 | Chen et al. | 248/220.21 |

FOREIGN PATENT DOCUMENTS

| | | | |
|---|---|---|---|
| DE | 43 19 479 | | 2/1995 |
| DE | 195 11 847 | | 10/1996 |
| DE | 196 05 972 | | 8/1997 |
| EP | 0 874 109 | | 10/1998 |
| EP | 1 039 067 | | 9/2000 |
| GB | 2 397 612 | | 7/2004 |
| JP | 2011084958 | A * | 4/2011 |

OTHER PUBLICATIONS

International Search Report.
European Office Action dated Jul. 20, 2010 with English translation of relevant parts.
European Office Action dated Sep. 16, 2010 with English translation of relevant parts.
German Search Report dated Apr. 7, 2009 with English translation of relevant parts.

* cited by examiner

SCAFFOLDING COMPRISING AN ANTI-RELEASE DEVICE FOR FLOORING UNITS

CROSS REFERENCE TO RELATED APPLICATIONS

This application is the National Stage of PCT/DE2009/000335 filed on Mar. 10, 2009, which claims priority under 35 U.S.C. §119 of German Application No. 10 2008 030 602.9 filed on Jun. 27, 2008, the disclosure of which is incorporated by reference. The international application under PCT article 21(2) was not published in English.

The invention relates to a scaffolding having at least one crossbeam, preferably U-shaped in cross-section, that extends between two vertical frame elements and connects these with one another, having at least one flooring unit, for example a catwalk or a frame floor, that has one or more mounting aids, preferably claws, for mounting the flooring unit in the or on the crossbeam, and having at least one anti-release device for securing the flooring unit against release, which device can be or is releasably connected with the crossbeam and has a securing body, preferably plate-shaped, particularly elongated, preferably made of metal, particularly from zinc-plated sheet steel, preferably a rail, to be laid onto the mounting aid or onto the mounting aids and/or for covering the mounting aid or the mounting aids, which body has at least one hook-shaped fastening element that engages through a hole provided in the crossbeam, preferably through an oblong hole that runs in the direction of the longitudinal axis of the crossbeam, in the state in which it is secured against release, and engages behind the crossbeam, at least in part, and whereby the securing body has a plate attached by means of a hinge at its one end, so as to pivot about a pivot axis, preferably an axis of rotation, preferably made of metal, particularly of zinc-plated sheet steel, which plate can be pivoted from an open position in which it allows both installation and removal or release of the anti-release device into a closed or securing position, in which the flooring unit is secured against release from or out of the crossbeam, whereby the length of the securing body including the plate approximately corresponds to the length of the crossbeam.

Such a scaffolding and such a securing device for securing against lift-off or lift-out of flooring units fixed in place on the crossbeams of the scaffolding with mounting aids has become known from DE 30 20 389 C2 and from practice. This design has the following advantages, among others:

By means of the configuration with hooks and oblong holes, mounting is facilitated, on the one hand, and the vertically active shape-fit connection is produced without complicated manual screwing work, on the other hand. The total length, with the pivoting plate, which is coordinated with the length, in each instance, secures the precise position of the securing body, so that mounting is guaranteed even for the long term. Furthermore, it can be seen from above whether or not the anti-lift-off or anti-lift-out device is mounted and secured against displacement. The interstice between the flooring units is continuously covered in its essential region, specifically at a height that corresponds to the walking surface, so that stumbling points are avoided. This securing device can be produced easily and can be mounted and removed quickly.

Although this securing device has excellently proven itself in practice, it has been shown that unlocking of the securing device can take place at high and extreme wind loads, because the securing plate is flipped up and/or because deformations occur, particularly in the region of the mounting hooks, thereby actually making it possible for lift-off of the flooring units to be secured to occur in individual cases, in an extreme case, and of course this must absolutely be avoided.

It is therefore a task of the invention to make available such a scaffolding having such an anti-release device, or such an anti-release device having an improved design, by means of which lift-out or lift-off of one or more flooring units is reliably avoided or prevented, with simple and fast mountability and removability, particularly at high and extreme wind loads, or by means of which increased security to prevent unintentional lift-out or lift-off of one or more flooring units can be achieved or is achieved.

This task is accomplished according to the invention by providing a plate securing aid that comprises a spring or is configured as a spring, by means of which aid the plate can be pivoted or is pivoted from its open position into its closed or securing position and/or can be held or is held in its closed or securing position. Preferably, the plate can be pivoted from the closed or securing position into the open position only when increased opening forces are applied, counter to the spring force of the spring, and/or cannot be pivoted from the closed or securing position into the open position without a prior unlocking procedure. By means of these measures, it is therefore possible to reliably hold the securing plate in its closed or securing position, and thereby to prevent it from flipping over into an open position when the wind is strong, and the flooring securing device then comes loose.

A helical spring, preferably at least one leg spring, can be used as the spring. In this way, advantageous force engagement and securing conditions can be achieved.

According to an advantageous embodiment, the leg spring can be formed as a double leg spring composed of a first leg spring and a second leg spring, which comprise, in each instance, a first leg and a second leg, whereby a first leg of the first leg spring and a first leg of the second leg spring are connected with one another in one piece or formed in one piece. In this way, particularly great closing and holding forces, respectively, can be implemented, with a simple and cost-advantageous design, to hold the securing plate in its closed or securing position.

In a further improvement, the first leg spring and the second leg spring can have or form a common, particularly a V-shaped or U-shaped leg.

Furthermore, it can be provided that when the securing body lies on the suspension aid or on the suspension aids and/or covers the suspension aid(s), at least a first leg of the or of each leg spring supports itself on a top of the securing body, and at least a second leg of the or of each leg spring supports itself on a top of the plate. This allows advantageous lever arm and securing conditions, with simple and cost-advantageous production and design.

According to an advantageous embodiment, it can be provided that the plate and/or the securing body has/have a, preferably first, stop body to prevent over-stretching of the spring during pivoting of the plate from the closed or securing position into the open position, in other words during an opening movement. In this way, it can be reliably prevented that the spring is over-stretched and consequently becomes unusable, so that maximal security against lift-out or lift-off is guaranteed even over a long period of time.

Alternatively, preferably additionally, it can be provided that the plate and/or the securing body has/have a, preferably a second, stop body to limit pivoting of the plate in the closing direction, into a position that allows simple assembly.

It is practical if the, preferably the first and/or the second, stop body is/are configured as a stop nose or a stop tongue. This allows a simple, cost-advantageous, and stable as well as reliable design.

Furthermore, it can be provided that the, preferably the first and/or the second, stop body of the plate is/are formed in one piece with the plate and/or that the, preferably the first and/or the second stop body of the securing body is/are formed in one piece with the securing body. In this way, the above advantages can be further improved.

Finally, it can be provided, also alternatively or additionally, that the, preferably the first and/or the second, stop body of the plate is/are formed out of the plate by means of forming or produced by means of forming of the plate and/or that the, preferably the first and/or the second stop body of the securing body is/are formed out of the securing body by means of forming or produced by means of forming of the securing body. This also allows particularly simple and cost-advantageous production and a particularly simple, stable, and reliable design.

In a preferred embodiment, it can be provided that the, preferably the first and/or the second, stop body engages/engage around the pivot axis of the hinge, at least in part. In this way, one or more stop bodies that can easily be produced can be made available, by means of which body/bodies one or more particularly stable securing end positions of the plate can be implemented.

In another preferred embodiment, it can be provided that the first stop body and the second stop body of the plate are formed out of the plate in different directions, or produced by means of forming of the plate in different directions, or that the first stop body and the second stop body of the securing body are formed out of the securing body in different directions, or produced by means of forming of the securing body in different directions. Such stop bodies can be produced in particularly simple and cost-advantageous manner, and allow limitation of the pivoting movement of the securing plate both in the opening direction and in the closing direction, in particularly simple and stable manner.

Alternatively or additionally, it can be provided that in the closed or securing position of the plate, the first stop body extends to above a plane spanned through the plate, and that the second stop body extends to below the plane spanned through the plate. In this way, the advantages mentioned above can also be achieved or implemented in an improved embodiment.

Furthermore, it can be provided that the plate, during its pivoting from the closed or securing position into the open position, makes contact against or with a or the, preferably first, stop body at an angle of inclination, relative to the securing body or to a plane that is spanned through it and contains its longitudinal axis, which angle is greater than zero degrees and/or at which angle the plate is not pivoted completely against or onto the securing body.

Preferably, the angle of inclination is greater than 10 degrees or 20 degrees and/or the angle of inclination is smaller than 135 degrees or 100 degrees. Particularly preferably, the angle of inclination amounts to approximately 90 degrees.

Furthermore or additionally, it can be provided that the plate, in the non-installed and/or installed state of the anti-release device, has force applied to it in the closing direction by the spring forces of the spring, in such a manner that the plate makes contact on or with a or the, preferably second, stop body, at an angle of inclination, relative to the securing body or to a plane spanned through it and containing its longitudinal axis, which angle is greater than 135 degrees, particularly greater than 170 degrees, and is smaller than 225 degrees, particularly smaller than 205 degrees. Preferably, this angle of inclination amounts to approximately 180 degrees.

According to a preferred embodiment of the invention or according to an alternative idea of the invention, the task of the invention can also or additionally be accomplished by having the hook-shaped fastening element consist of flat steel and/or, in the state in which it is secured against release, be delimited, at least in a region that corresponds to the height of the free mounting end of the mounting aid or of the free ends of the mounting aids, preferably essentially over its entire length, preferably formed below the securing unit, by parallel side surfaces that extend parallel to the longitudinal axis of the securing body, at a distance from one another that corresponds to the thickness of the fastening element.

Aside from the fact that the task of the invention is accomplished also by means of these measures alone or in addition, and the corresponding advantages can be achieved, even more advantages can be achieved by the above measures. For example, if the hook-shaped fastening element consists of flat steel, in comparison with the fastening elements that have been used until now, and consist of a comparatively soft, formable steel or sheet steel, which can be formed by means of cold forming or cold work, the hook-shaped fastening element can now be produced from a higher-strength steel. By this alone, it is possible to achieve greater strengths and carrying capacities in combination with greater security against deformations of the hook-shaped fastening elements, and consequently greater security against canting and/or lift-off or lift-out of the entire anti-release device. Furthermore, more support-capable cross-sections can be achieved with such hook-shaped fastening elements that consist of flat steel. If the hook-shaped fastening element consists of flat steel and/or is delimited by parallel side surfaces that extend parallel to the longitudinal axis of the securing body, at a distance from one another, it is possible, by selecting a suitable distance or a suitable thickness, in contrast to the comparatively broad fastening elements according to the state of the art, which narrow conically downward toward the hook end, to prevent a collision of the hook-shaped fastening element with the mounting aid or with the mounting aids of the flooring unit or flooring units during assembly. In particular, even in the case of longer crossbeams, it is not necessary to pay attention to the placement of the individual flooring units, which might have different widths, because a collision of the mounting aids of the flooring units with the hook-shaped fastening elements of the anti-release device can now be avoided or prevented. Therefore the aforementioned measures allow greater flexibility or variability with regard to the selection of flooring units having different widths, particularly in the case of long crossbeams, because now a collision of the hook-shaped fastening element or of the hook-shaped fastening elements with the mounting aids of flooring units, particularly aids that lie opposite them, can be avoided or prevented.

In an advantageous embodiment of the two ideas of the invention, it can be provided that the hook-shaped fastening element consists of solid material. In this way, further improved strengths and carrying capacities can be achieved.

In a particularly preferred embodiment of the two ideas of the invention, it can be provided that the hook-shaped fastening element is produced in a manner free of edging or bending, preferably free of forming, particularly by means of punching. This allows particularly cost-advantageous production and design.

In a particularly preferred embodiment of the two ideas of the invention, it can be provided that the distance between the side surfaces or the thickness of the hook-shaped fastening element, in the state in which it is secured against release, is smaller, at least in a region that corresponds to the height of the free end of the mounting aid or the free ends of the mounting aids, preferably essentially over its entire length, particularly formed below the securing unit, than the horizontal distance between at least two mounting aids mounted opposite one another in or on one and the same crossbeam, of two flooring units that extend in different directions away from the crossbeam and/or follow one another. In this way, the hook-shaped fastening element easily finds space even between two mounting aids that lie opposite one another, so that the width of the flooring units, or the placement of or distance between the mounting aids of the flooring units, respectively, is not important. Thus, when using an anti-release device that is configured to be coordinated with a specific length of a crossbeam, by having a matching length, it is possible to use flooring units of any desired width with mounting aids that are segmented or spaced in any desired manner, over the mounting or contact length of the crossbeam.

In another preferred embodiment of the two ideas of the invention, it can be provided that the face side of the free end of the securing body is provided with an oblong recess that runs in the axial direction, for accommodating the fastening body formed with or from flat material, particularly a fastening wedge for fastening the crossbeam to one of the vertical frame elements, and that the face side of the free end of the pivoting plates is provided with a similar or identical recess, whereby the recesses are configured as a recess slit, in each instance, as is known from DE 30 20 389 C2, whereby, however, additionally, the slit is delimited, preferably essentially over its entire slit length, by parallel slit walls, which have a distance from one another that corresponds to the slit width, which is of the same size or only slightly greater than the thickness of the flat material of the fastening body, so that if only on one side of the crossbeam, at least one flooring unit is mounted in or on it with its mounting aid or with its mounting aids, the anti-release device can be canted or is canted on the flat material of the fastening body, in such a manner that it does not tilt or is not tilted, or tilts only slightly or only insignificantly, or is only slightly or only insignificantly tilted about its longitudinal axis.

In order to ensure this, it is practical if the slit width is maximally 25%, preferably maximally 20%, particularly approximately 17% greater than the thickness of the flat material of the fastening body accommodated in the slit.

It is understood that the aforementioned measures and characteristics, also those relating to the two independent ideas of the invention mentioned above, can be combined in any desired manner within the scope of implementability.

Further characteristics, advantages, and aspects of the invention can be derived from the following description part, in which a preferred exemplary embodiment of the invention is described in greater detail, using the figures.

Figure 2:
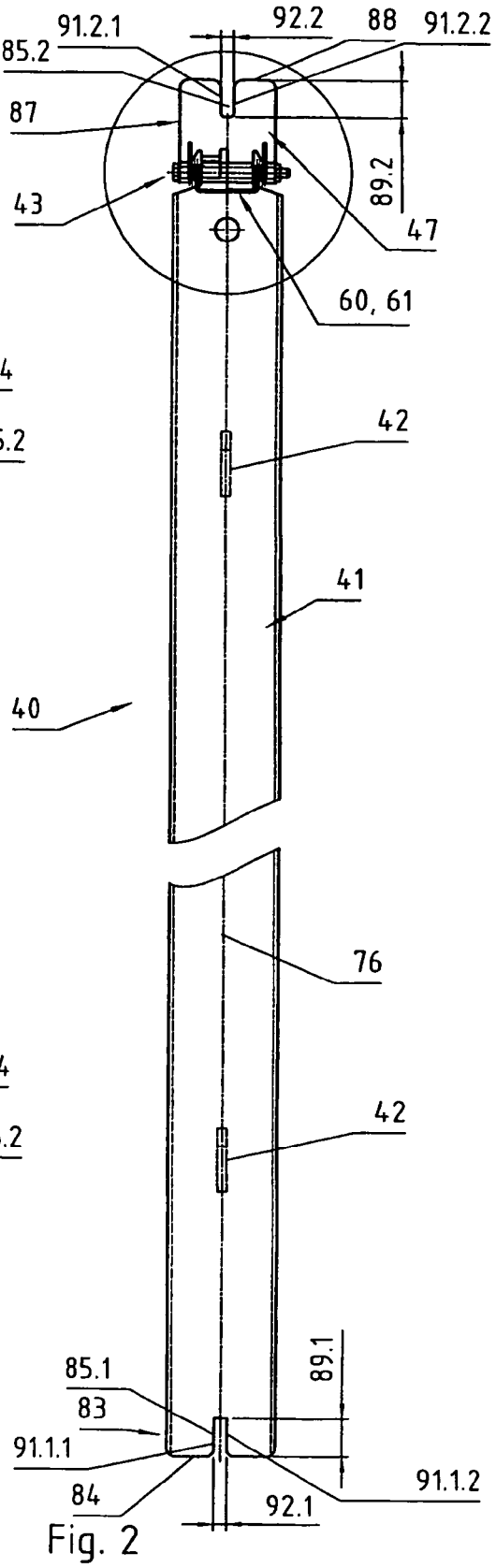
Figure 3:
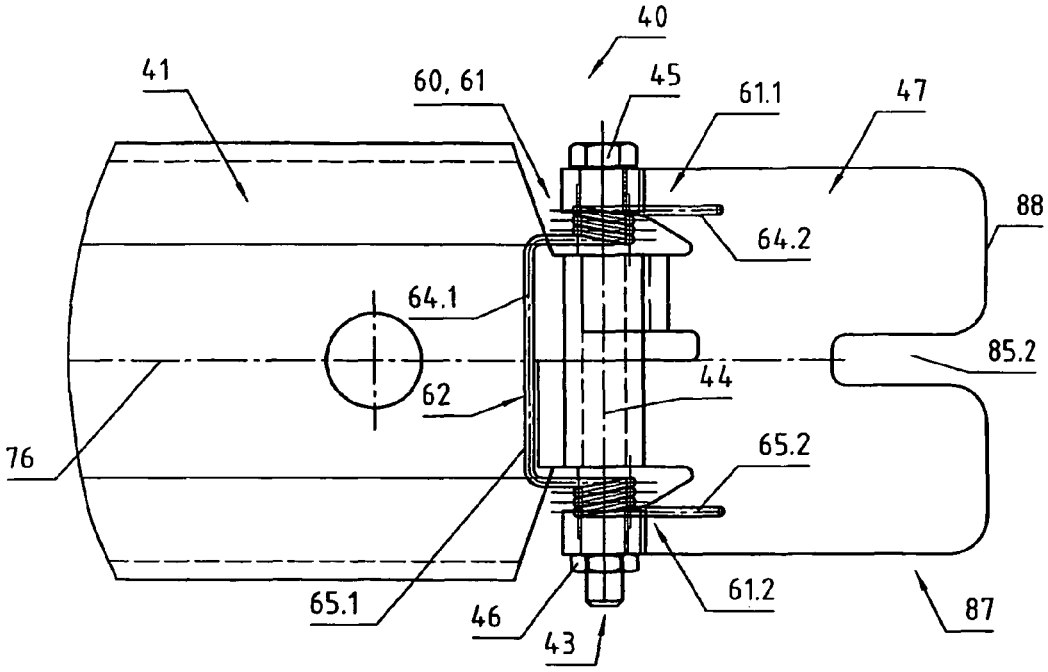
Figure 4:
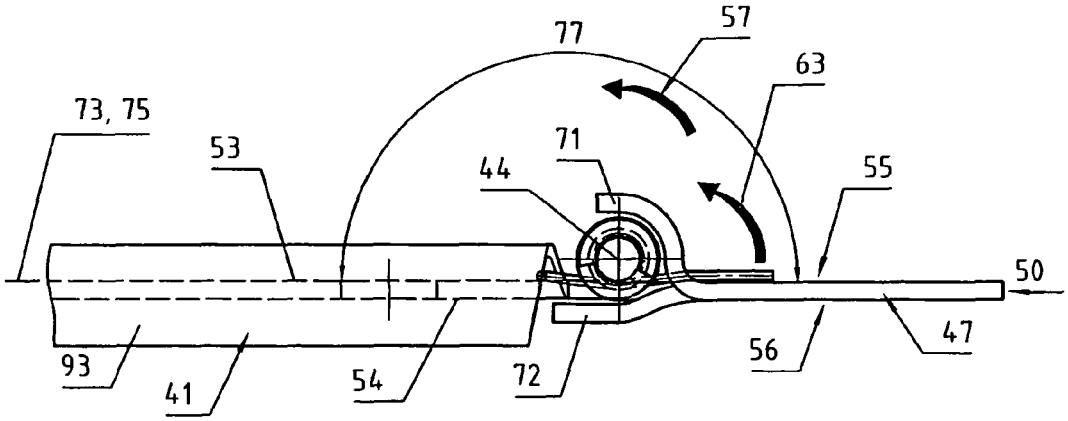
Figure 5:
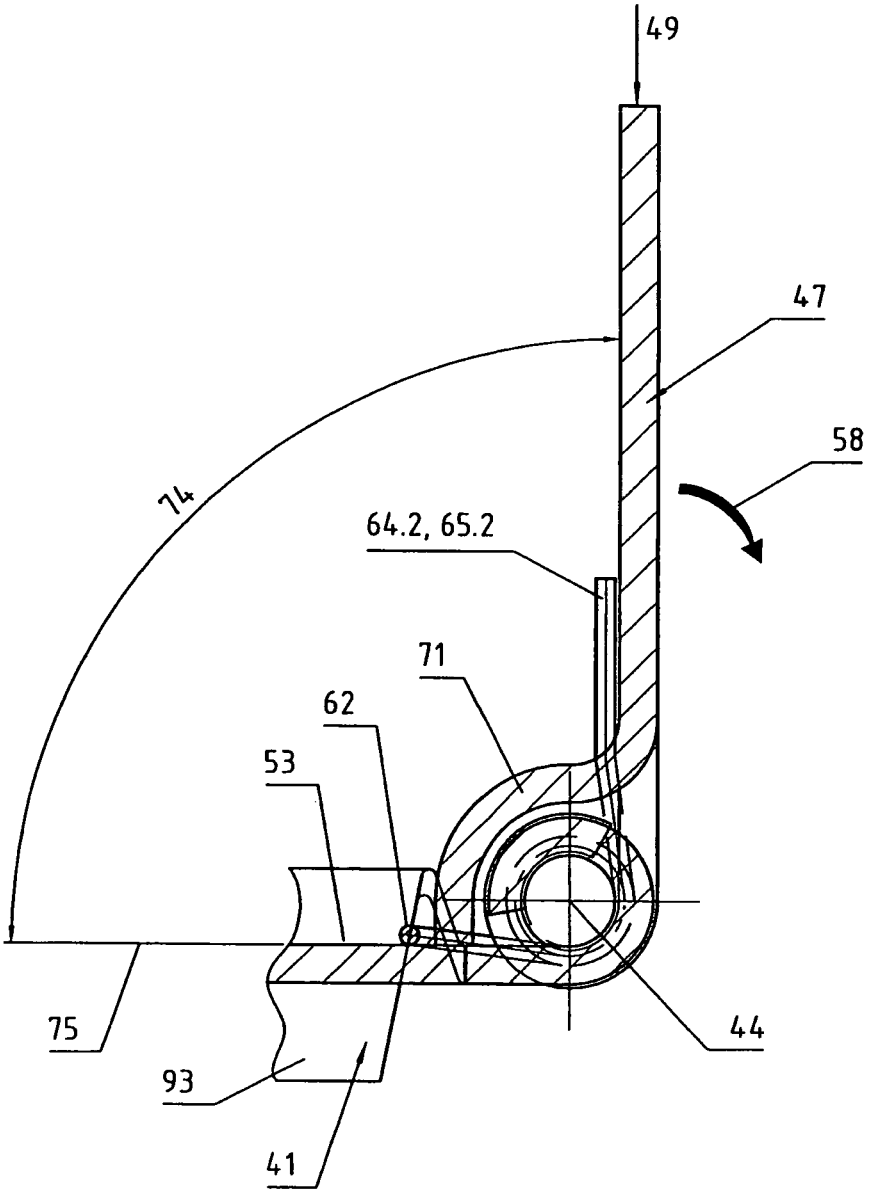
Figure 6:
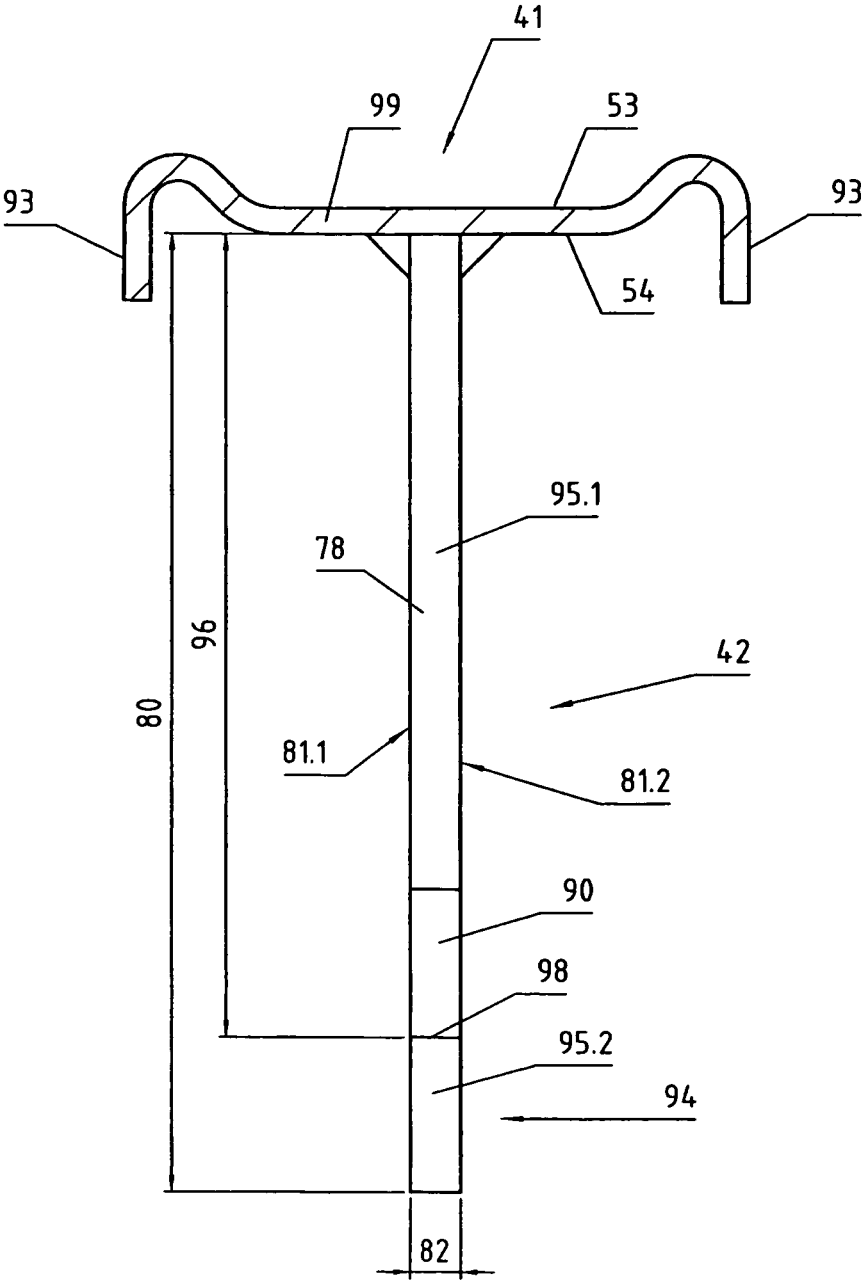
Figure 7:
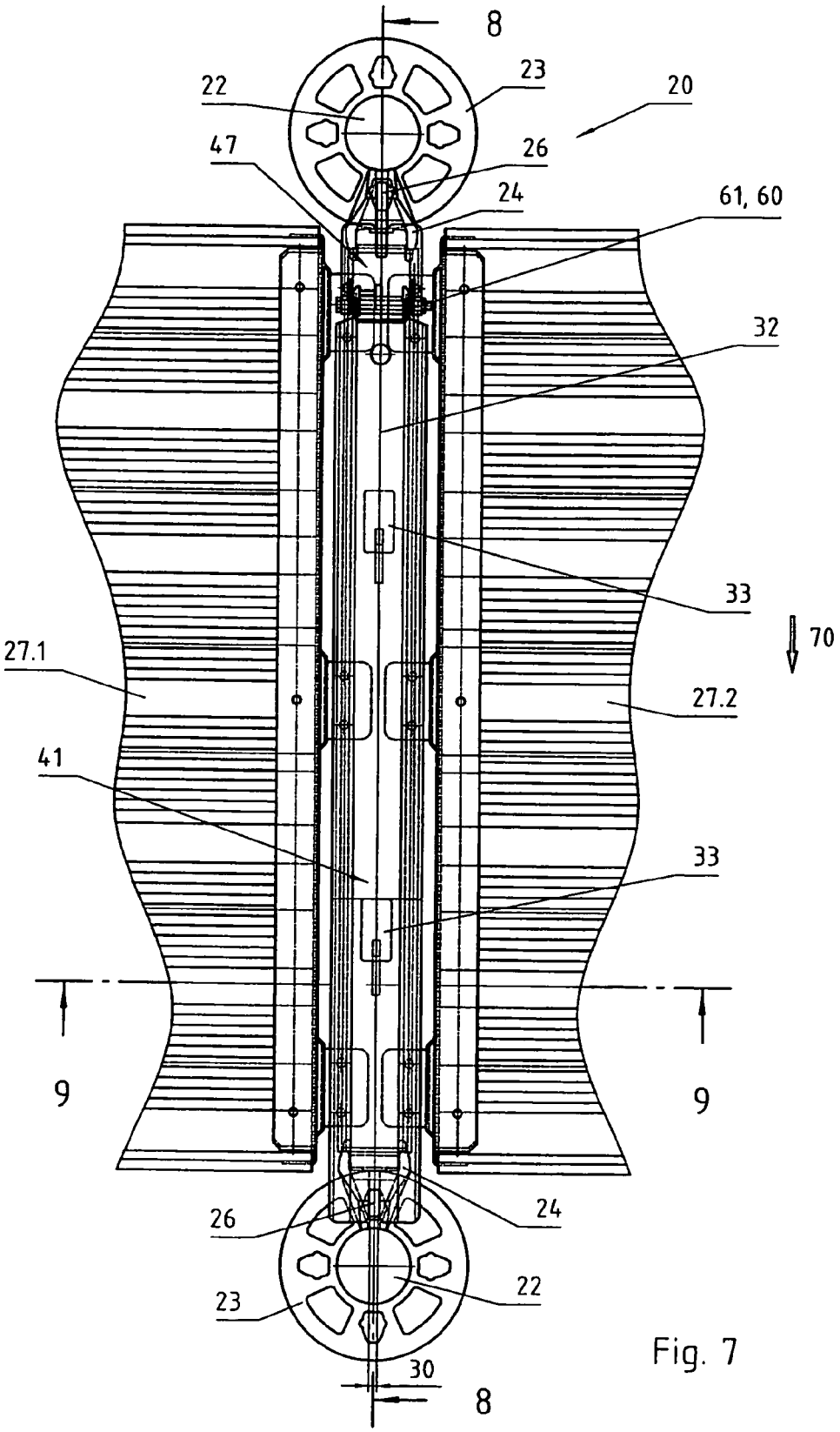
Figure 8:
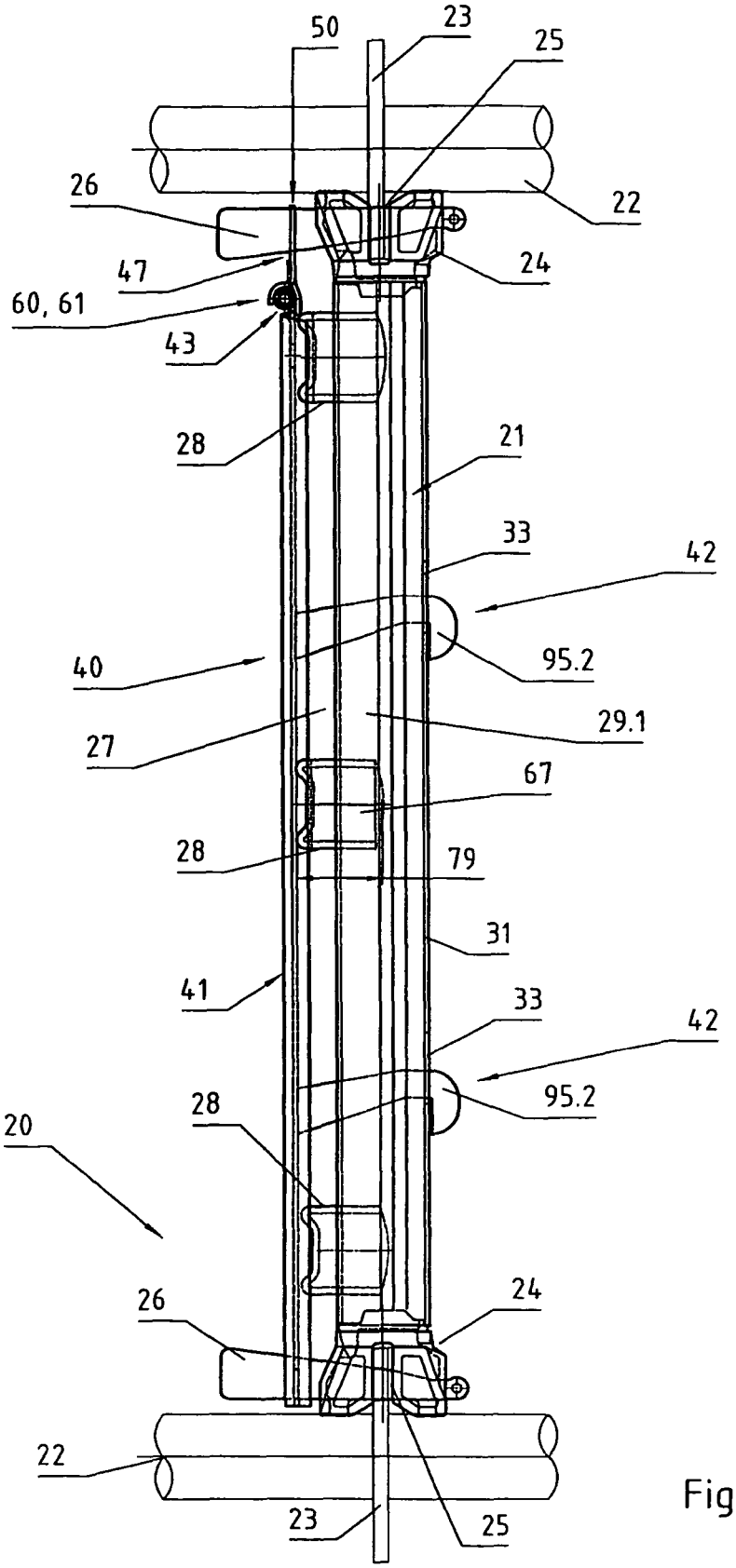
Figure 9:
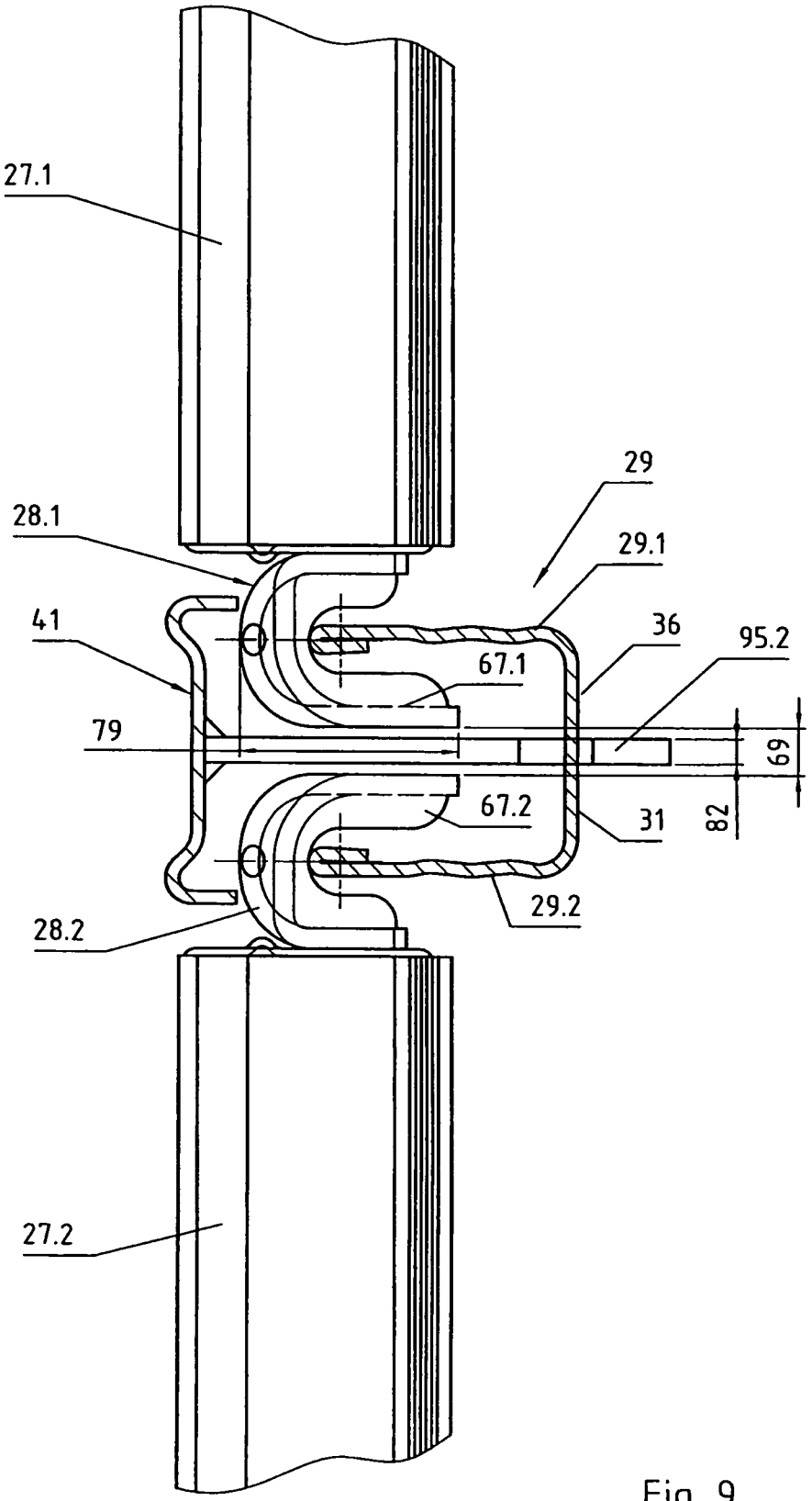

These show:

FIG. 1 a side view of an anti-release device according to the invention;

FIG. 2 a top view of the anti-release device according to FIG. 1;

FIG. 3 an enlarged representation of the end of the anti-release device formed with a pivoting plate and marked with a circle in FIG. 2;

FIG. 4 an enlarged representation of the end of the anti-release device formed with a pivoting plate and marked with a circle in FIG. 1, whereby the pivoting plate is shown in its securing position;

FIG. 5 an enlarged representation of the detail according to FIG. 4, with the pivoting plate, which has been pivoted into a maximal opening position;

FIG. 6 an enlarged cross-section of the anti-release device along the section lines 6-6 in FIG. 1;

FIG. 7 a join of two flooring units that follow one another and extend away from one another in opposite directions, which are mounted in or on a crossbeam, with the properly laid-on or mounted anti-release device in a top view;

FIG. 8 a section through the arrangement according to FIG. 7, along the section line 8-8 in FIG. 7;

FIG. 9 a section through the arrangement according to FIG. 7, along the section line 9-9, on an enlarged scale.

FIGS. 7 to 9 show an anti-release device 40 according to the invention in a practical use for a scaffolding 20 according to the invention. Such a scaffolding 20 can be built up from vertical frame elements 22, which are also called posts, as well as from diagonal frame elements and/or horizontal frame elements that can be fixed in place on them, whereby in the figures, a crossbeam 21 is shown as a horizontal frame element. The frame elements that run diagonally and horizontally can be connected and fixed in place on the vertical frame elements 22 in such a manner that they engage around a connecting flange 23 situated on the vertical frame element 22, which can be a rosette, preferably a perforated disk provided with passage holes, with a connecting shoe or connecting head 24, provided with a horizontal slit 25 which head can preferably be configured as a wedge head, and are fixed in place on the flange, rosette, or disk by means of a fastening body 26, here in the form of a fastening wedge 26. In the exemplary embodiment shown in the figures, the fastening wedge 26 is inserted through a wedge opening in an upper head part and in a lower head part of the connecting head 24, in each instance, for this purpose, and also through a hole of the here eight passage holes of the perforated disk or rosette 23. By means of hitting the fastening wedge 26 into place, preferably using a hammer, the crossbeam 21 shown in the figures can be wedged in place or connected with two of the vertical frame element 22, in firm and torsion-resistant manner.

The crossbeam 21 is a U-shaped crossbeam 21 in the case of the exemplary embodiment shown in FIGS. 7 to 9. This crossbeam therefore has a U-shaped cross-section, as can be seen in FIG. 9, in a sectional plane perpendicular to its longitudinal axis 32. It is understood, however, that crossbeams having different cross-sections, for example round pipes, if necessary in combination with different mounting aids configured in adapted manner, can also be used. The crossbeam 21 that has a U-shaped cross-section is formed with a base or a crosspiece 31, from which two contact crosspieces 29.1 and 29.2 extend away in the same direction, perpendicular to it and at a distance from one another as well as approximately parallel. In the region of their free ends, the contact crosspieces 29.1 and 29.2 have contact edges for contact with the flooring units 27. The contact edges are preferably bent away or angled away inward. In the crosspiece or in the base 31 of the crossbeam 21, holes 33 are provided, at a distance from one another, here two holes configured as oblong holes. The distance between them and their placement and dimensioning are configured to be coordinated with the anti-release device 40 according to the invention, particularly in such a manner that after the securing body 41 of the anti-release device 40 has been applied, and after the device has been moved into the desired end position, the hook parts 95.2 engage to below the base or the crosspiece 31 of the crossbeam 21, at the end edges of the hole 33, in each instance, in other words engage behind the crossbeam and lie directly on it or are disposed at a slight distance from it.

As is also evident from FIGS. 7 to 9, one or more flooring units 27; 27.1, 27.2 can be secured against lift-out from or out of or against lift-off from the cross-beam 21, using an anti-release device 40 according to the invention.

The precise design of a preferred exemplary embodiment of an anti-release device 40 according to the invention, including design details, is particularly evident from FIGS. 1 to 6.

The anti-release device 40 comprises, as the essential elements, a securing body 41, here a plate-shaped body, which is configured as a rail here, and furthermore comprises a plate 47 that is connected with the securing body 41 by way of a hinge 43, so as to pivot. Furthermore, the anti-release device 40 comprises hook-shaped fastening elements 42, here two elements, which are attached to the underside 54 of the securing body 41, preferably by means of welding, at an axial distance from one another. The plate-shaped securing body 41 is configured as an elongated rail here, which preferably consists of zinc-plated sheet steel. The securing plate 47 can also consist of metal, preferably of zinc-plated sheet steel. The connection between the plate 47 and the securing body 41 is made by way of the hinge 43. In the exemplary embodiment, the hinge 43 is formed with a screw 45 that comprises a threaded pin, here a hex screw 45, and a nut 46 that serves to secure it. The plate 47 has an eye or sleeve produced by means of forming, for example bending or crimping, on the side facing the securing body 41, in the region of its two outer edges, through which eyes or sleeves the threaded pin of the screw 45 is inserted.

The securing body 41 also has an eye or sleeve produced by means of forming, for example bending or crimping, on its end assigned to the plate 47, in a central region that extends on both sides of the longitudinal axis 76, through which eye or sleeve the threaded pin of the screw 45 is also inserted.

Between the two eyes or sleeves of the plate 47 and the eye or sleeve of the securing body 41, a screw-shaped part of a spring 61, configured as a double leg spring 61 here, is disposed, through which part the threaded pin of the screw 45 also extends, in each instance. The double leg spring 61 comprises two leg springs 61.1 and 61.2. The first leg spring 61.1 has a first leg 64.1 and a second leg 64.2, and the second leg spring 61.2 also has a first leg 65.1 and a second leg 65.2. The first leg 64.1 of the first leg spring 61.1 and the first leg 65.1 of the second leg spring 61.2 are connected or formed in one piece with one another, here with the formation of a common U-shaped leg 62. This U-leg 62 supports itself on the top 63 of the securing body 41, in a contact region that is essentially flat there, which region is disposed between the two lateral edgings 93 that extend in the axial direction or parallel to the longitudinal axis 76 of the securing body 41, which edgings bring about a reinforcement of the securing body 41. The other legs 64.2 and 65.2 of the spring 61 support themselves on the top 55 of the plate 47. The spring 61 is disposed and dimensioned in such a manner that the spring forces of the spring 61 impact the plate 47 in the closing direction 48 (FIG. 5).

The spring 61 forms a plate securing aid 60, by means of which the plate 47 can be pivoted or is pivoted from an open position, as it is shown, for example, in FIG. 5, in the form of a maximal open position 49, into a closed or securing position 50 (FIGS. 4 and 8). The plate 47 can only be pivoted from the closed or securing position 50 into a or the open position 49 by means of applying increased opening forces (see arrow 63), counter to the spring force of the spring 61. In this manner, the plate 47 is therefore held in its closed or securing position 50 by the spring force of the spring 61, if the anti-release device 40 is in its anti-release position (see FIGS. 7 and 8). Consequently, the plate 47 would be held in the closed position 50 not only due to its inherent weight, but additionally by the spring forces of the spring 61.

For the purpose of limiting the opening movement of the plate 47 in the opening direction 57, particularly for the purpose of preventing over-stretching of the spring 61 during pivoting of the plate 47 from its closed or securing position 50 into a or the open position 49, the plate 47 is provided with a stop body 71, also called a first stop body, which is configured as a stop tongue 71 here. This stop body or this stop tongue 71 is formed in one piece with the plate 47, and is formed out of the plate by means of forming, for example by means of bending or crimping, specifically here in such a manner that the stop body 71 extends to above a plane 73 spanned through the plate 47, and, in this connection, partly engages around the threaded pin of the nut 46, which contains the pivot axis 44.

The plate 47 furthermore has a stop body 72, also called a second stop body, which serves to bring about a limitation of the closing movement in the closing direction 58 when the plate 47 is pivoted in the closing direction 58, in such a manner that after the stop body 72 makes contact with the underside 54 of the securing body 41, a position 59 of the plate 47 relative to the securing body 41 that allows simple assembly is achieved. In the exemplary embodiment, the plate 47 is in this position 59 in a location relative to the securing body 41 in which the plane 73 spanned through the plate and the plane 75 spanned through the securing body 41 are approximately parallel or in which only a slight angle of inclination of these planes relative to one another has been reached. As is evident from FIG. 4, this position 49 approximately corresponds to the closed or securing position 50. In this closed or securing position 50 or in a position of the plate 47 that differs from it by only a slight angle in the closing direction 58, the stop 72 has therefore made contact with the underside 54 of the securing body 41.

As is also evident from FIG. 4, the stop body 72 is also formed in one piece with the plate 47, and is also formed out of the plate 47, by means of forming. In contrast to the first or other stop body 71, however, the stop body 72, also called the second stop body, is formed out the plate 47 in such a manner that it extends to below the plane 43 spanned through the plate 47. The stop body 72 also engages around the threaded pin of the screw 45 of the hinge 43 that contains the pivot axis 44, in part.

As is evident from FIG. 5, the plate 47 or its stop body 71, respectively, makes contact, when the plate 47 is pivoted from its closed or securing position 50 into an open position, because of the stop body 71, at an angle of inclination 74 relative to the securing body 41 or relative to a plane 75 spanned through the securing body 41 and containing its longitudinal axis 76, which angle is greater than zero degrees and amounts to approximately 90 degrees here. In this open position 49, the plate 47 is therefore in its maximal open position 49, in other words it is pivoted by about 90 degrees in the opening direction 57, into its maximal open position 49, as compared with the closed position 50 shown in FIG. 4. In this way, the result is achieved that the spring 61 is not over-stretched, so that reliable function is guaranteed over a long time.

In contrast to this, as is particularly evident from FIG. 4, the plate 47 has the spring forces of the spring 61 applied to it in the closing direction 58 both in the non-installed state and in the installed state of the anti-release device 40, so that the plate 47, with the, preferably second, stop body 72 makes contact with the underside 54 of the securing body 41 at an angle of inclination 77 relative to the securing body 41 or to a plane 75 that is spanned through it and contains its longitudinal axis 76, which angle amounts to about 180 degrees here.

It is a particular advantage of the anti-release device 40 according to the invention that in order for it to be installed, in other words for the purpose of mounting it on or in the crossbeam 21, in order to achieve anti-release security, the plate 47 does not necessarily have to first be pivoted into an open position that allows assembly, or does not have to first be situated in an open position that is swung in, in the direction of the securing body 41, but rather the plate is already in an assembly position, because of the spring force of the spring 61 and because of the provision as well as the placement and the configuration of the stop 72, in which position simple assembly can be achieved when mounting and displacing the securing body 41.

The placement and the configuration of the here two hook-shaped fastening elements 42 is particularly evident from FIGS. 1, 2, 6, and 9; these are preferably attached to the underside of the securing body 41 or the rail 41 by means of welding (see FIG. 6). According to the invention, the fastening elements 42 are formed from flat steel 78. In the exemplary embodiment, the fastening elements 42 are delimited, essentially over their entire length 80, by parallel side surfaces 81.1 and 81.2, which extend parallel to the longitudinal axis 76 of the securing body 41, at a distance 82 that corresponds to the thickness 82 of the fastening element 42, in each instance. This thickness 82 or this distance 82 amounts to 5 mm in the exemplary embodiment. The hook-shaped fastening elements 42 consist of solid material and are produced free of edging or bending, preferably free of forming, by means of punching.

The distance 82 between the side surfaces 81.1 and 81.2 or the thickness 82 of the hook-shaped fastening element 42 is essentially smaller, over its entire length 80, than the horizontal distance 69 between two mounting aids 28.1, 28.2, here claws, that are mounted opposite one another on one and the same crossbeam 21, of two flooring units 27.1, 27.2 that follow one another at a joint, or of two flooring units 27.1, 27.2 that extend away from the crossbeam 21 in different directions (FIG. 9). In this manner, the fastening element 42 or the hook-shaped fastening elements 42 therefore cannot collide with the mounting aids 28; 28.1, 28.2, independent of the placement or position of the mounting aids 28; 28.1, 28.2 on the side or on top of the crossbeam 21.

Each hook-shaped fastening element 42 consists of a fastening part 95.1 and of a hook part 95.2. The fastening element 42 is attached to the securing body 41 with its fastening part 95.1. In the region of the transition between the fastening part 95.1 and the hook part 95.2, a flat contact surface 90 is provided, which here is formed perpendicular to the longitudinal axis 76 of the securing body 41 or perpendicular to the plane 75 that is spanned by it and contains the longitudinal axis 76. The hook part 95.2 of the fastening element 42 extends in a direction that points away from the end of the securing body 41 that is provided with the plate 47. The hook part 95.2 has an anti-release surface 98 on its top 98, which surface is configured here approximately parallel to the longitudinal axis 76 of the securing body or parallel to the plane 75 spanned by the securing body 41 and containing the longitudinal axis 76. In the state secured against release, this top 98 or this anti-release surface 98 engages behind the underside or outer surface 36 of the crosspiece or the base 31 of the crossbeam 21, as is evident from FIGS. 8 and 9.

The face side 84 of the free end 83 of the securing body 41 is provided with an oblong recess that runs in the axial direction, in the form of a slit 85.1, which is suitable and intended for accommodating a fastening body 26 formed with or from flat material, particularly a fastening wedge 26, preferably for fastening the crossbeam 21 to one of the vertical frame elements 22. The face side 88 of the free end 87 of the plate 47 is provided with a similar or identical recess 85.2 also configured in the form of a slit 85.2.

Each slit 85.1 and 85.2 is delimited, essentially over its entire slit length 89.1, 89.2, with parallel slit walls 91.1.1, 91.1.2; 91.2.1, 91.2.2, which have a distance 92.1 or 92.2 between them that corresponds to the slit width 92.1 or 92.2. This distance 92.1, 92.2 is only slightly greater than the thickness 30 of the flat material of the fastening body 26 configured as a fastening wedge 26 here, so that if only on one side of the crossbeam 21, at least one flooring unit 27 is mounted in or on it with its mounting aid 28 or with its mounting aids 28, the anti-release device 40 can be canted or is canted on the flat material of the fastening body 26, in such a manner that it does not tilt or is not tilted, or tilts only slightly or only insignificantly, or is only slightly or only insignificantly tilted about its longitudinal axis 76.

In the exemplary embodiment, the slit width 92.1, 92.2 amounts to 7 mm, in each instance, and the thickness 30 of the flat material of the fastening body 26 or of the fastening wedge 26 amounts to 6 mm. Accordingly, the slit width 92.1, 92.2 in the exemplary embodiment is approximately 17% greater than the thickness 30 of the flat material of the fastening body 26 or of the fastening wedge 26. Therefore, if the flat material, in each instance, of the fastening body 26 or the fastening wedge 26, in each instance, is situated in the slit 85.1 of the securing body 41 or in the slit 85.2 of the plate 47, in the anti-release position of the anti-release device 40, only a slight gap remains between the flat material of the fastening body 26 and the slit walls 91.1.1, 91.1.2; 91.2.1, 91.2.2, in each instance, which gap amounts to maximally about 1 mm here.

To build up the scaffolding 20, after fastening the crossbeam 21 to the vertical frame elements 22, the flooring unit or the flooring units 27; 27.1, 27.2 that follow one another, are mounted, in the case of an end region from one side, and in the case of an intermediate region from both sides, using the mounting aids 28; 28.1, 28.2 provided on the face sides and structured as claws here, on the flanges 29 that face upward or on the contact crosspieces 29.1, 29.2 that face upward, of the crossbeam 21 (FIG. 9), and then the securing body 41, which is configured as a rail, is laid onto the mounting aids 28.1, 28.2 in the direction from above, whereby the free end 83 of the securing body 41 is brought downward in such a manner that the hinge 43 or the plate 47 moves along the edges or the flat sides of the fastening body 26 configured as a fastening wedge 26, and the hook-shaped fastening elements 42 engage through the holes that are configured as oblong holes 33 here.

The fastening elements 42 are dimensioned in such a manner that the distance of the top 98 or of the anti-release surface 98 of the hook parts 95.2 from the underside 54 or from the lower surface 54 of the securing body 41 is preferably precisely great enough so that the hook part 95.2 lies against the outer surface 36 of the crosspiece or of the base 31 of the crossbeam 21 after the securing body 41 has been moved in or displaced into its end position, or is situated only at a slight distance from this outer surface 36. As soon as the securing body 41 or the rail 41 lies on the mounting aids or claws 28; 28.1, 28.2 of the flooring units 27; 27.1, 27.2 with its edges 93, whereby the hook-shaped fastening elements 42 engage through the oblong holes 33 in the crossbeam 21, preferably whereby the plate 47 lies on or against the fastening body 26, configured as a fastening wedge 26 here, counter to the spring force of the spring 61, by lying on top of or against it, the securing body 41 is displaced in the direction of the arrow 70 (FIG. 7) or in a direction that corresponds to the expanse of the hook parts 95.2, so far until the slit 85.1 of the securing body 41 engages around the fastening wedge 26. In an end position determined by the contact surfaces 90 of the hook-shaped fastening elements 42 and their contact with the face edges of the oblong holes 33 in the crossbeam 21, or just before it, the plate 47 automatically folds downward in the closing direction 58, into its closed or securing position 50, because of the spring forces of the spring 61, in which position the slit 85.2 of the plate 47 then therefore also engages around a fastening wedge 26.

In this closed or securing position 50, the plate 47 prevents a displacement of the securing body 41 or of the entire anti-release device 40 in a direction opposite the arrow 70. Furthermore, in this end position or in this anti-release position, the hook parts 95.2 of the hook-shaped fastening elements 42 then engage under the crosspiece or the base 31 of the crossbeam 21, so that release of the anti-release device 40 and consequently of the flooring unit 27 or the flooring units 27.1, 27.2 is prevented by the anti-release device 40.

REFERENCE SYMBOL LIST

20 scaffolding
21 crossbeam
22 vertical frame element/post
23 rosette/connecting flange/perforated disk
24 connecting head/wedge head
25 horizontal slit
26 fastening body/fastening wedge
27 flooring unit/frame floor/catwalk
27.1 flooring unit/frame floor/catwalk
27.2 flooring unit/frame floor/catwalk
28 mounting aid/claw
28.1 mounting aid/claw of 27.1
28.2 mounting aid/claw of 27.2
29 flange/contact crosspiece
29.1 contact crosspiece
29.2 contact crosspiece
30 thickness of 26
31 crosspiece/base of 21
32 longitudinal axis of 21
33 hole/oblong hole
36 outer surface of 31
40 anti-release device
41 securing body/rail
42 fastening element
43 hinge
44 pivot axis/axis of rotation
45 screw/threaded bolt
46 nut
47 plate
48 open position
49 maximal open position
50 closed/securing position
53 top of 41
54 underside of 41
55 top of 47
56 underside of 47
57 opening direction
58 closing direction
59 position of 47
60 plate securing aid
61 spring/double leg spring
61.1 leg spring
61.2 leg spring
62 U-shaped leg of 61
63 arrow (opening force)
64.1 first leg of 61.1
64.2 second leg of 61.1
65.1 first leg of 61.2
65.2 second leg of 61.2
66 eye
67 mounting end
67.1 mounting end
67.2 mounting end
69 distance
70 displacement direction
71 (first) stop body/stop tongue
72 (second) stop body/stop tongue
73 plane
74 angle of inclination
75 plane
76 longitudinal axis of 41 and 40, respectively
77 angle of inclination
78 flat steel
79 height
80 length of 42
81.1 side surface of 42
81.2 side surface of 42
82 thickness of 42/horizontal distance between 81.1 and 81.2
83 free end of 41
84 face side of 83
85.1 recess/slit
85.2 recess/slit
87 free end of 47
88 face side of 87
89.1 slit length of 85.1
89.2 slit length of 85.2
90 stop surface
91.1.1 slit wall of 85.1
91.1.2 slit wall of 85.1
91.2.1 slit wall of 85.2
91.2.2 slit wall of 85.2
92.1 slit width/distance
92.2 slit width/distance
93 edging of 41
94 lower end of 42
95.1 fastening part of 42
95.2 hook part of 42
96 distance
98 top/anti-release surface of 95.2
99 plate-shaped base body of 41

The invention claimed is:

1. Scaffolding having:

at least one crossbeam that extends between two vertical frame elements and connects these with one another;

at least one flooring unit that has at least one mounting aid for mounting the flooring unit to the crossbeam; and at least one anti-release device for securing the flooring unit against release from the crossbeam, which anti-release device is releasably connected with the crossbeam and has:

a securing body to be laid onto the at least one mounting aid, which securing body has at least one hook-shaped fastening element that, in the state in which it is secured against release, engages through a hole provided in the crossbeam, and at least in part behind the crossbeam, a plate attached by a hinge at one end of the securing body, which plate can be pivoted from an open position in which it allows both installation and removal or release of the anti-release device into a closed or securing position, in which the flooring unit is secured against release from or out of the crossbeam, whereby the length of the securing body including the plate approximately corresponds to the length of the crossbeam, and a plate securing aid that comprises a spring for at least one of pivoting the plate from its open position into its closed or securing position and holding the plate in its closed or securing position, wherein the spring is a helical spring which is formed as a double leg spring composed of a first leg spring and a second leg spring, which comprises, in each instance, a first leg and a second leg, wherein the first leg of the first leg spring and a first leg of the second leg spring are formed in one piece and form a common v-shaped or u-shaped leg, wherein at least one of the plate and the securing body has a first stop body to prevent over-stretching of the spring during pivoting of the plate from the closed or securing position into the open position, wherein the first stop body is formed in one piece with at least one of the plate and the securing body, wherein the first stop body engages at least in part around a pivot axis of the hinge, wherein the plate, during its pivoting from the closed or securing position into the open position, makes contact against or with the first stop body at an angle of inclination, relative to a plane that is spanned through the securing body and contains the longitudinal axis of the securing body, which angle of inclination is at least one of greater than zero degrees and such that the plate is not pivoted completely against or onto the securing body, wherein at least one of the plate and the securing body has a second stop body to limit pivoting of the plate in the closing direction, into a position that allows simple assembly, and wherein the second stop body engages at least in part around the pivot axis of the hinge.

2. Scaffolding according to claim 1, wherein at least one of the first stop body and the second stop body is configured as a stop nose or a stop tongue.

3. Scaffolding according to claim 1, wherein the second stop body is formed in one piece with at least one of the plate and the securing body.

4. Scaffolding according to claim 1, wherein the first stop body of the plate and the second stop body of the plate are formed from the plate so as to extend in different directions from the plate, or wherein the first stop body of the securing body and the second stop body of the securing body are formed from the securing body so as to extend in different directions from the securing body.

5. Scaffolding according to claim 1, wherein in the closed or securing position of the plate, the first stop body extends to above a plane spanned through the plate, and wherein the second stop body extends to below the plane spanned through the plate.

6. Scaffolding according to claim 1, wherein the plate, at least in the non-installed state of the anti-release device, has force applied to it in the closing direction by the spring force of the spring, in such a manner that the plate makes contact on or with the second stop body, at an angle of inclination, relative to the securing body or to a plane spanned through it and containing its longitudinal axis, which angle is greater than 135 degrees and is smaller than 225 degrees.

7. Scaffolding according to claim 6, wherein the angle of inclination is greater than 170 degrees and smaller than 205 degrees.

8. Scaffolding according to claim 1, wherein the hook-shaped fastening element comprises solid material.

9. Scaffolding according to claim 1, wherein the hook-shaped fastening element is produced in a manner free of edging or bending.

10. Scaffolding according to claim 1, wherein the crossbeam is attached to one of said frame elements using a fastening body formed with or from flat material, and wherein a face side of a free end of the securing body is provided with an oblong recess that extends in the axial direction, for accommodating the fastening body, and wherein the face side of the free end of the pivoting plate is provided with a similar or identical recess, whereby the recess and the similar or identical recess are configured, in each instance, as a slit, which is delimited by parallel slit walls, which have a distance from one another that corresponds to the slit width, which is of the same size or only slightly greater than the thickness of the flat material of the fastening body, so that if only on one side of the crossbeam, at least one flooring unit is mounted in or on it with its at least one mounting aid, the anti-release device is canted on the flat material of the fastening body, in such a manner that it is not tilted about its longitudinal axis.

11. Scaffolding according to claim 10, wherein the slit width is maximally 25% greater than the thickness of the flat material of the fastening body accommodated in the slit.

* * * * *